US007408557B2

(12) United States Patent
Ko et al.

(10) Patent No.: US 7,408,557 B2
(45) Date of Patent: Aug. 5, 2008

(54) APPARATUS AND METHOD FOR ADJUSTING BRIGHTNESS AND COLOR TEMPERATURE

(75) Inventors: Kyung-pill Ko, Suwon-si (KR); Mi-Sook Jang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/657,714

(22) Filed: Sep. 9, 2003

(65) Prior Publication Data

US 2004/0130555 A1 Jul. 8, 2004

(30) Foreign Application Priority Data

Sep. 13, 2002 (KR) ..... 10-2002-0055644

(51) Int. Cl.
*G09G 5/02* (2006.01)

(52) U.S. Cl. ..... 345/590

(58) Field of Classification Search ..... 345/589, 345/690, 691, 102, 89, 99, 594, 3.1, 590; 382/311, 162; 348/345, 603
See application file for complete search history.

(56) References Cited

U.S. PATENT DOCUMENTS

| | | | | |
|---|---|---|---|---|
| 6,285,344 | B1 * | 9/2001 | Everard et al. | 345/3.1 |
| 6,292,228 | B1 * | 9/2001 | Cho | 348/603 |
| 6,611,249 | B1 * | 8/2003 | Evanicky et al. | 345/102 |
| 6,791,567 | B1 * | 9/2004 | Segal | 345/590 |
| 7,084,880 | B2 * | 8/2006 | Kimura et al. | 345/589 |
| 2002/0051584 | A1 * | 5/2002 | Shimizu et al. | 382/311 |
| 2002/0163527 | A1 * | 11/2002 | Park | 345/594 |
| 2004/0001165 | A1 * | 1/2004 | Shiota et al. | 348/678 |
| 2005/0031199 | A1 * | 2/2005 | Ben-Chorin et al. | 382/162 |

(Continued)

FOREIGN PATENT DOCUMENTS

| | | | |
|---|---|---|---|
| CN | 1241098 | A | 1/2000 |

(Continued)

OTHER PUBLICATIONS

Office Action dated May 13, 2005 of Chinese Patent Application No. 03158454.3.

(Continued)

*Primary Examiner*—Kee M. Tung
*Assistant Examiner*—Aaron M Richer
(74) *Attorney, Agent, or Firm*—Staas & Halsey LLP

(57) ABSTRACT

An apparatus and method automatically adjusting the brightness and the color temperature of a screen to an optimum state according to input RGB signals. The apparatus includes an RGB color signal generator and a system controller. The RGB color signal generator determines a maximum value of each of the input RGB color signals and a total maximum value, compares the total maximum value with a predetermined critical value, adjusts the brightness level of the input RGB color signals based on the comparison result, compares the maximum values, and if one of the maximum values is higher than the others, generates RGB color signals, one of which has a color temperature varying according to a predetermined value. The system controller provides the RGB color signal generator with data on the predetermined critical value and a reference value used for detecting the color signal having the higher maximum value.

16 Claims, 3 Drawing Sheets

U.S. PATENT DOCUMENTS

2005/0168620 A1* 8/2005 Shiraishi ..... 348/345

FOREIGN PATENT DOCUMENTS

CN 1290921 A 4/2001
JP 7-23414 1/1995
KR 2002-0056946 7/2002

OTHER PUBLICATIONS

Korean Office Action for corresponding Korean Patent Application No.:10-2002-0055644 dated Jun. 23, 2004 (2 pgs).

* cited by examiner

APPARATUS AND METHOD FOR ADJUSTING BRIGHTNESS AND COLOR TEMPERATURE

CROSS-REFERENCE TO RELATED APPLICATION

This application claims the benefit of Korean Patent Application No. 2002-55644, filed on Sep. 13, 2002, in the Korean Intellectual Property Office, the disclosure of which is incorporated herein by reference.

BACKGROUND OF THE INVENTION

1. Field of the Invention

The present invention relates to an image display apparatus, and more particularly, to an apparatus and method for automatically adjusting the brightness and the color temperature of a screen on which input RGB color signals are displayed, according to the input RGB color signals.

2. Description of the Related Art

With an existing image display apparatus, the brightness and the color temperature of a screen is adjusted with values set by a user using an on-screen display (OSD) menu, or with adjustment values set when manufacturing the image display apparatus.

In the above method, values necessary for adjusting the brightness and the color temperature are set, in consideration of the brightness levels and the color temperatures of RGB color signals input, when adjusting the brightness and the color temperature of the screen. Thus, in a case where the brightness and the color temperature of an input RGB color signal vary, the user has to readjust the brightness and the color temperature of the screen using the OSD menu.

SUMMARY OF THE INVENTION

The present invention provides an apparatus and method for automatically adjusting the brightness and the color temperature of a screen to a substantially optimum state according to input RGB signals.

According to an aspect of the present invention, an apparatus is provided for adjusting the brightness of a screen on which input RGB color signals are displayed. The apparatus includes an RGB color signal generator and a system controller. The RGB color signal generator is capable of detecting a total maximum value of the RGB color signals, comparing the total maximum value with a predetermined critical value, and increasing or decreasing the brightness level of an image displayed on the screen based on the comparison by generating other RGB color signals. The system controller provides the predetermined critical value to the RGB color signal generator.

According to an aspect of the present invention, the predetermined critical value includes a first predetermined critical value determined in considering a case where the brightness of pixels, in an area of the screen from which the total maximum value is detected, corresponds to substantially full white and a second predetermined critical value determined in considering a case where the brightness level of pixels in the area corresponds to substantially full black.

If a total maximum value that is detected is greater than the first predetermined critical value, the RGB color signal generator decreases the brightness level of the image on the screen, using a predetermined ratio, by generating less bright RGB color signals, and if a total maximum value is less than the second predetermined critical value, the RGB color signal generator increases the brightness level of the image on the screen by another predetermined ratio by generating brighter RGB color signals. Predetermined ratios are set using data provided from the system controller based on reference data input by a user.

In another aspect of the present invention, the RGB color signal generator windows a predetermined area of the screen and then detects a total maximum value of RGB color signals in the predetermined area. The predetermined area is determined depending on the highest resolution supported by a display on which the image is displayed.

According to another aspect of the present invention, an apparatus is provided adjusting a color temperature of a screen on which input RGB color signals are displayed. The apparatus includes an RGB color signal generator and a system controller. The RGB color signal generator detects a maximum value of each of the RGB color signals, compares the maximum values, and if one of the maximum values is higher than the others, generates other RGB color signals, one of which has a color temperature increased to a predetermined value. The system controller provides the RGB color signal generator with the predetermined value and data on the conditions necessary for detecting a color signal having the higher maximum value than the others.

According to another aspect of the present invention, the system controller provides a reference value necessary for comparing the maximum values and detecting a color signal having a higher maximum value than the other color signals with the data on the conditions. This reference value is set based on a difference value such that a user perceives a maximum value of a color signal displayed on the screen to be higher than those of the other color signals. The RGB color signal generator detects the maximum values of the RGB color signals in each frame.

According to still another aspect of the present invention, a method is provided of adjusting the brightness of a screen on which input RGB color signals are displayed. A total maximum value of the input RGB color signals is detected. The total maximum value is compared with first and second predetermined critical values. If the total maximum value is greater than the first predetermined critical value, the brightness level of an image is decreased by another predetermined ratio to generate less bright RGB color signals. If the total maximum value is less than the second predetermined critical value, the brightness level of the image is increased by a predetermined ratio to generate brighter RGB color signals.

According to yet another aspect of the present invention, there is provided a method of adjusting a color temperature of a screen on which input RGB color signals are displayed. Maximum values of the RGB color signals are detected. The maximum values are compared to detect a color signal having a higher maximum value than the others. If one of the maximum values is higher than the others, in generating another RGB color signal, a color temperature is increased to a predetermined value.

Additional aspects and advantages of the invention will be set forth in part in the description which follows and, in part, will be obvious from the description, or may be learned by practice of the invention.

BRIEF DESCRIPTION OF THE DRAWINGS

These features, and/or other aspects and advantages of the invention will become apparent and more readily appreciated from the following description of the embodiments taken in conjunction with accompanying drawings in which.

DETAILED DESCRIPTION OF THE INVENTION

Figure 1:
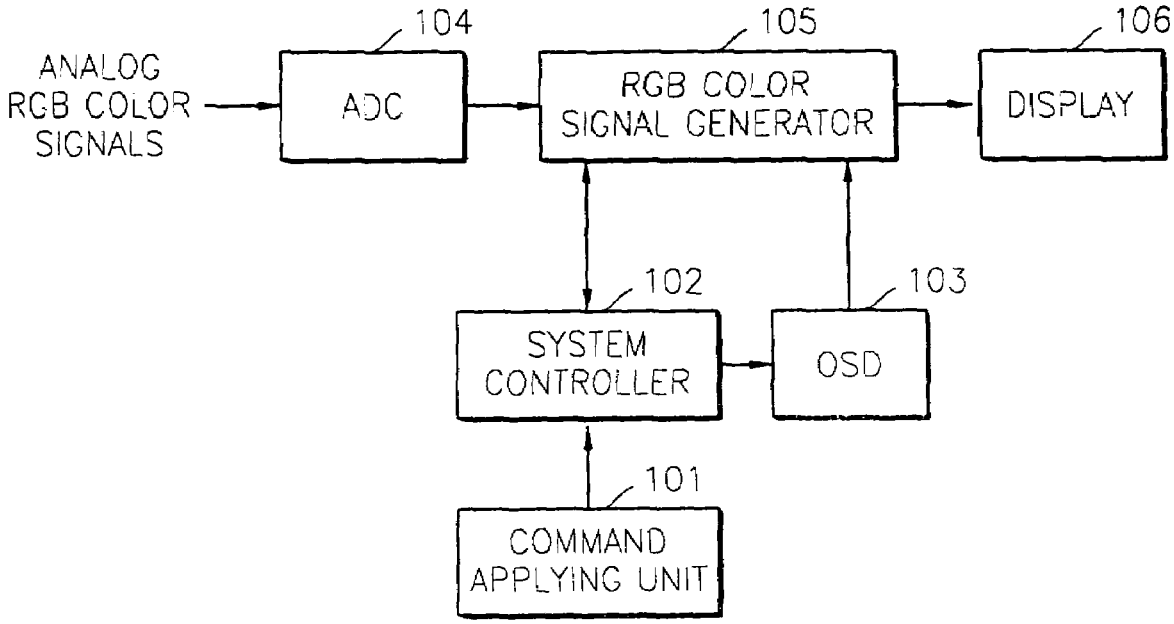
FIG. 1 is a block diagram of an apparatus adjusting the brightness and the color temperature of a screen according to an aspect of the present invention.

Reference will now be made in detail to the embodiments of the present invention, examples of which are illustrated in the accompanying drawings wherein like reference numerals refer to the like elements throughout. The embodiments are described below in order to explain the present invention by referring to the figures.

FIG. 1 is a block diagram of an apparatus adjusting the brightness and the color temperature of a screen according an aspect of the present invention. Referring to FIG. 1, the apparatus includes a command applying unit 101, a system controller 102, an OSD 103, an analog-to-digital converter (ADC) 104, an RGB color signal generator 105, and a display 106.

The command applying unit 101 inputs a command from a user to the system controller 102. According to one aspect of the present invention, the user may input reference values necessary for automatically adjusting the brightness and the color temperature of a screen via the command applying unit 101. The reference values are a brightness level and a color temperature value that the user desires to obtain with respect to an image displayed on the display 106.

The reference values may be set via an OSD menu displayed on the display 106. In other words, if the output of a corresponding OSD menu via the command applying unit 101 is requested, the system controller 102 controls the OSD 103 to output the corresponding OSD menu. Thus, the OSD 103 transmits data on the corresponding OSD menu to the RGB color signal generator 105. The RGB color signal generator 105 outputs corresponding RGB signals to the display 106, so that the corresponding OSD menu is displayed. The user sets the reference values of the brightness level and the color temperature value via the OSD menu displayed on the display 106.

If the reference values are set, the system controller 102 sets a windowing area for input RGB color signals based on the highest resolution supported by the display 106. The windowing area is used in adjusting the brightness level of the input RGB color signals. A first predetermined critical value is set considering a case where the brightness level of pixels in the windowing area corresponds to substantially full white. A second predetermined critical value is set considering a case where the brightness level of pixels in the windowing area corresponds to substantially full black. The windowing area may be a whole or a portion of an image.

The system controller 102 determines the value for increasing and/or decreasing the brightness level of the input RGB color signals based on the reference values input by the user. For example, if the system controller 102 determines that a brightness level of the input RGB color signals is too high, the system controller 102 determines how much the brightness level should be lowered, based on reference values, to make a user comfortable. In contrast, if the controller system 102 determines that the brightness level of the input RGB color signals is too low, the system controller 102 determines how much the brightness level should be increased based on the same reference values in order to make the user comfortable.

A reference value and a predetermined value necessary for adjusting the color temperature of a screen are set based on the input reference values. The reference value is used when comparing maximum values of the input RGB color signals and detecting a color signal having a higher maximum value than the other color signals of the input RGB color signals. In other words, the color temperature of a color signal detected based on the reference value is compensated for. The reference value is set based on a difference value, such that the user can perceive that the color temperature of the color signal displayed on the screen having a higher maximum value than color temperatures of the other color signals displayed on the screen.

The predetermined value is set to control the compensation degree of color temperature. In other words, if the RGB color signal, a color temperature of which has to be compensated for, is detected, the color temperature of a newly generated RGB color signal is increased to the predetermined value.

The system controller 102 provides first and second critical values, data on the increase and decrease ratios, and data on the reference value and the predetermined value to the RGB color signal generator 105.

The ADC 104 converts input analog RGB color signals into digital RGB color signals. The digital RGB color signals are transmitted to the RGB color signal generator 105.

Based on the values provided from the system controller 102, the RGB color signal generator 105 detects and stores the maximum value of each of the input RGB color signals, detecting and storing the total maximum value of the input RGB color signals. The total maximum value is the sum of the maximum values of the RGB color signals. The maximum values are a maximum value of each of the RGB color signals. In other words, a maximum value of the R color signal, a maximum value of the G color signal, and a maximum value of the B color signal are detected and stored. For example, the total maximum value of one frame image is the sum of color values of RGB color signals of pixels in that one frame image. Each of the maximum values is the sum of color values of the R color signal of pixels in that one frame image, the sum of color values of the G color signal, and the sum of color values of the B color signal. The total maximum value is obtained from pixels in the windowing area and the maximum values of the RGB color signals are obtained from all pixels in a screen.

The first and second critical values provided from the system controller 102 are compared with the total maximum value. If the total maximum value is greater than the first critical value, the brightness level of the input RGB color signals is reduced by a predetermined ratio. If the total maximum value is less than the second predetermined critical value, the brightness level of the input RGB color signals is increased by a predetermined ratio.

A difference value is detected by comparing the maximum values of the RGB color signals. If the difference value is greater than the reference value provided from the system controller 102, a color signal, which has a color value greater than the reference value compared with the other color signals, exists. The RGB color signal generator 105 detects this color signal having the color value greater than the reference value as a color signal having a color temperature to be compensated for, and compensates for the color signal. In other words, the color temperature of the detected color signal is increased to the predetermined value provided from the system controller 102.

The RGB color signals, the brightness level and the adjusted color temperatures are transmitted to the display 106. The adjusting of brightness and color temperatures of the input RGB color signals may be performed in each frame.

In the above-described embodiment, the brightness and the color temperatures of a screen according to input RGB color signals are adjusted based on reference values of the brightness and the color temperatures of the input RGB color signals that a user inputs via the command applying unit 101. However, alternatively, the brightness and the color temperatures of a screen of input RGB color signals may be adjusted based on predetermined reference values without the user's ongoing participation.

Figure 2:
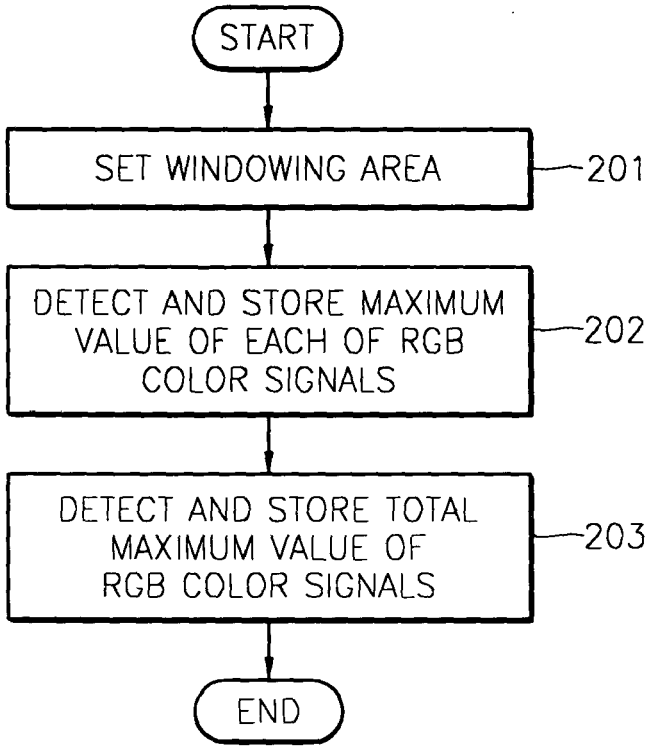
FIG. 2 is a flowchart for explaining a process of analyzing input data in a method for adjusting the brightness and the color temperature of a screen according to another aspect of the present invention.

FIG. 2 is a flowchart for explaining a process of analyzing input data in a method of adjusting the brightness and the color temperature of a screen according to an embodiment of the present invention.

RGB color signals are input, in operation 201, as described with reference to FIG. 1, and a windowing area is set in a screen based on the highest resolution supported by the display 106. The windowing area is used in detecting the brightness levels of the input RGB color signals so as to adjust the brightness.

In operation 202, maximum values of the input RGB color signals of an image are detected and stored. The maximum values of the input RGB color signals are as described with reference to FIG. 1.

In operation 203, the total maximum value of the RGB color signals of pixels in the windowing area is detected and stored. The total maximum value is as described with reference to FIG. 1.

Figure 3:
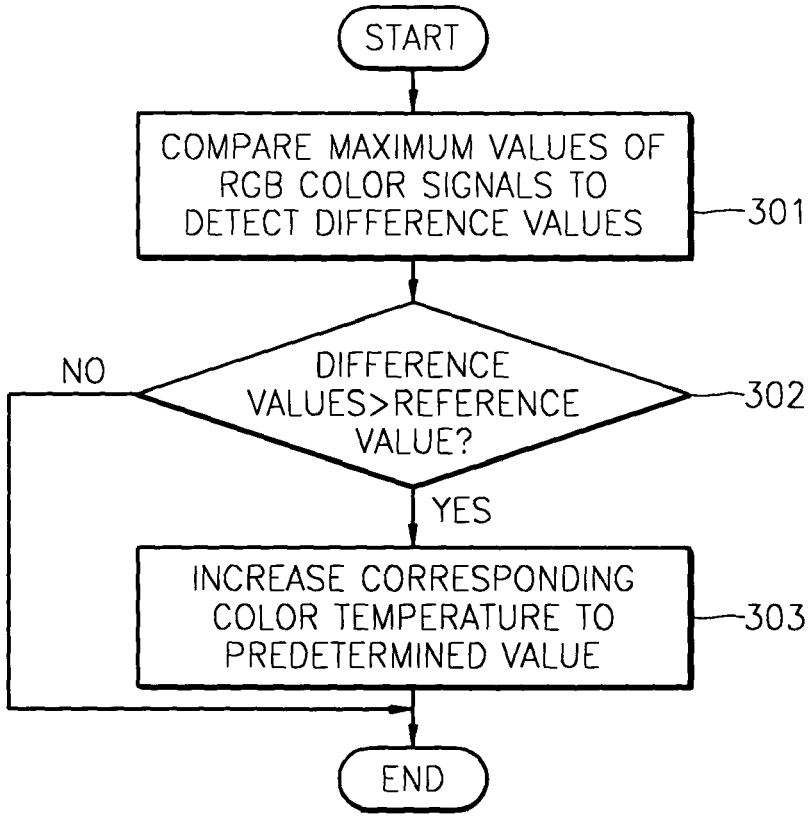
FIG. 3 is a flowchart for explaining a process of adjusting the color temperature in a method for adjusting the brightness and color temperature of a screen according to another aspect of the present invention.

FIG. 3 is a flowchart for explaining a process of adjusting a color temperature in a method of adjusting the brightness and the color temperature of a screen according to another aspect of the present invention.

In operation 301, the maximum values of the RGB color signals stored in operation 202 are compared to detect difference values.

In operation 302, it is checked whether a detected difference value is greater than a reference value. As described with reference to FIG. 1, the reference value is used to detect a color signal having a color temperature requiring compensation. If a difference value is greater than the reference value, in operation 303, the color temperature of the color signal generating the difference value, is increased to a predetermined value and the process stops. Thus, RGB color signals with adjusted color temperatures are generated.

Figure 4:
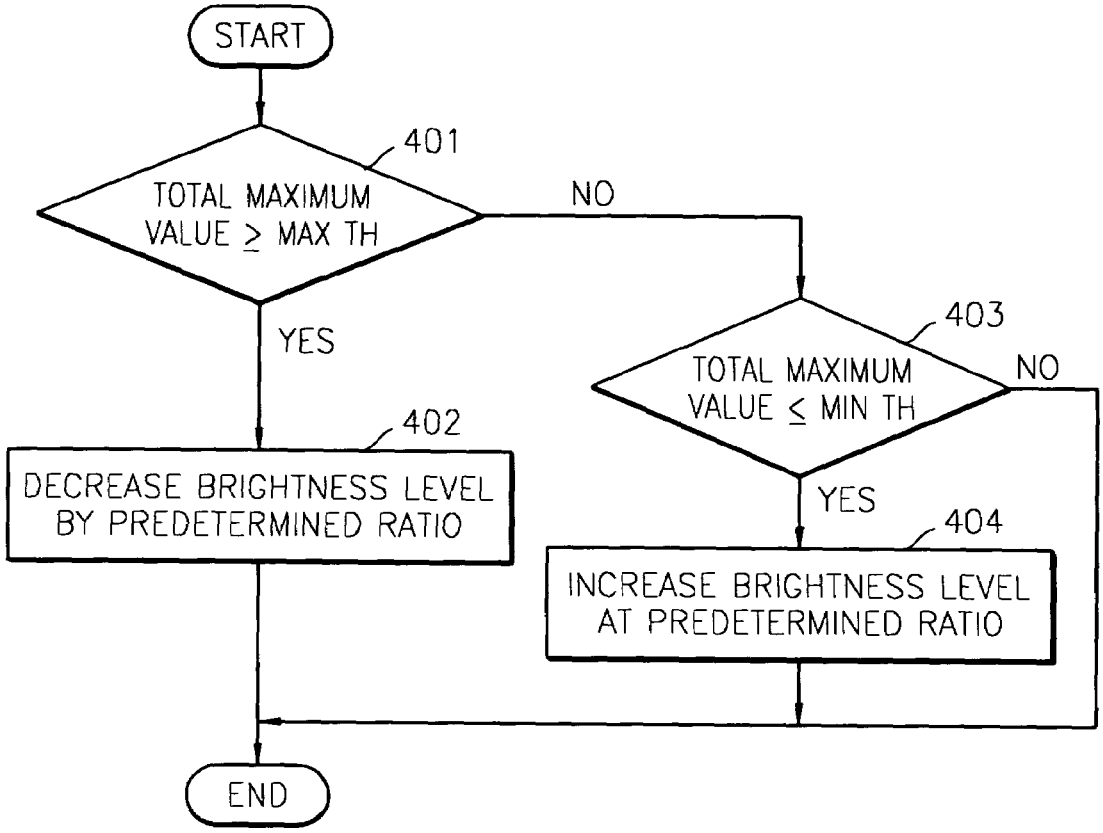
FIG. 4 is a flowchart for explaining a process of adjusting the brightness in a method for adjusting the brightness and the color temperature of a screen according to another aspect of the present invention.

FIG. 4 is a flowchart for explaining a process of adjusting brightness in a method of adjusting brightness and a color temperature of a screen according to another aspect of the present invention.

In operation 401, it is determined whether the total maximum value of the RGB color signals in the windowing area stored in operation 203 is greater than a maximum critical value MAX TH. The maximum critical value MAX TH corresponds to the first predetermined critical value described with reference to FIG. 1. In other words, the maximum critical value MAX TH is determined considering a case where the brightness level of pixels in the windowing area corresponds to substantially full white.

If in operation 401, it is determined that the total maximum value is greater than the maximum critical value MAX TH, then in operation 402, the brightness level of the input RGB color signals is reduced by a predetermined ratio and the process stops.

If in operation 401, however, it is determined that the total maximum value is less than or equal to the maximum critical value MAX TH, then in operation 403, it is determined whether the total maximum value is less than a minimum critical value MIN TH. The minimum critical value MIN TH is the second predetermined critical value described with reference to FIG. 1. In other words, the minimum critical value MIN TH is determined considering a case where the brightness level of pixels in the windowing area corresponds to substantially full black.

If in operation 403, the total maximum value is less than the minimum critical value MIN TH, then in operation 404, the brightness level of the input RGB color signals is increased by a predetermined ratio and the process stops.

As described with reference to FIG. 1, the predetermined ratios in operations 402 and 404 are determined by a reference value and a predetermined value set by a user to adjust the brightness and the color temperature.

As described above, by automatically adjusting the brightness and the color temperature of a screen according to input RGB color signals, a user can see a clear screen having a constant brightness level and color temperature without the need for additionally adjusting the brightness and the color temperature whenever the values thereof vary.

For example, in a case where a document having a high contrast ratio is displayed on a screen e.g., black letters on a white screen, the brightness level of the screen is automatically reduced by a predetermined ratio based on a predetermined reference value. Alternatively, when games or moving pictures are displayed on the screen, the entire screen may appear darker. In this case, the brightness level of the screen may be automatically increased by a predetermined ratio based on a predetermined reference value. As a result, screen images comfortable for user viewing can be easily provided.

According to other aspects of the invention, the system controller 102 or other component is a computer implementing the method shown in FIGS. 2-4 using data encoded on a computer-readable medium Although a few embodiments of the present invention have been particularly shown and described, it would be appreciated by those skilled in the art that changes may be made therein in these embodiments without departing from the principles and spirit of the invention, the scope of which is defined in the claims and their equivalents.

What is claimed is:

1. An apparatus for adjusting a brightness and a color temperature of a screen on which input RGB color signals are displayed, the apparatus comprising:

a RGB color signal generator to detect a maximum value of each of the RGB color signals, to compare the maximum values, to detect a color signal having a higher maximum value than the other color signals of the RGB color signals, to increase the color temperature of the detected color signal to a predetermined value to compensate for the color temperature of the detected color signal, to detect a total maximum value of the RGB color signals, and to store the total maximum value of the RGB color signals; and a system controller to provide a predetermined critical value, the predetermined value, and data on conditions for detecting a color signal having the higher maximum value than the other color signals to the RGB color signal generator, wherein the RGB color signal generator increases or decreases a brightness level of an image displayed on the screen by one of a plurality of predetermined ratios based on the comparison result, wherein the RGB color signal generator generates RGB color signals having decreased brightness by decreasing the brightness level of the image by one of the plurality of the predetermined ratios if the total maximum value is greater than a first predetermined critical value, determined in a case wherein a brightness level of pixels in an area of the screen from which the total maximum value is detected corresponds to full white, wherein the RGB color signal generator generates RGB color signals having increased brightness by increasing the brightness level of the image by one of the plurality of the predetermined ratios if the total maximum value is less than a second predetermined critical value, determined in consideration of a case wherein a brightness level of pixels in the area of the screen from which the total maximum value is detected corresponds to full black, and wherein the detecting and storing the total maximum value of the RGB color signals includes windowing a predetermined area of the screen, and then detecting the total maximum value of the RGB color signals in the predetermined area.

2. The apparatus of claim 1, wherein the predetermined critical value comprises a first predetermined critical value determined in a case where the brightness level of pixels in an area of the screen from which the total maximum value is detected corresponds to full white, and a second predetermined critical value determined in a case where the brightness level of pixels in the area corresponds to full black.

3. The apparatus of claim 2, wherein if the total maximum value is greater than the first predetermined critical value, the RGB color signal generator generates less bright RGB color signals by decreasing the brightness level of the image on the screen by one of the predetermined ratios, and if the total maximum value is less than the second predetermined critical value, the RGB color signal generator generates brighter RGB color signals by increasing the brightness level of the image on the screen by another of the predetermined ratios.

4. The apparatus of claim 3, wherein the predetermined ratios are set using data provided from the system controller based on a reference data input by a user.

5. The apparatus of claim 1, wherein the RGB color signal generator windows a predetermined area of the screen, and then detects the total maximum value of the RGB color signals in the predetermined area.

6. The apparatus of claim 5, wherein the predetermined area is determined depending on a highest resolution supported by the screen on which the image is displayed.

7. The apparatus of claim 1, wherein the brightness of the screen is automatically adjusted.

8. The apparatus of claim 1, wherein the data on the conditions for detecting a color signal having the higher maximum value than the other color signals includes a reference value used in comparing the maximum values and detecting the color signal having the higher maximum value than the other color signals, and the reference value is set based on a difference value such that a user perceives a maximum value of the color signal displayed on the screen to be higher than those of the other color signals.

9. The apparatus of claim 1, wherein the RGB color signal generator detects the maximum values of the RGB color signals in each frame.

10. The apparatus of claim 1, wherein the color temperature of the screen is automatically adjusted.

11. An apparatus adjusting brightness and color temperature of a screen on which input RGB color signals are displayed, the apparatus, comprising:

an RGB color signal generator to determine a maximum value of each of a plurality of color signals comprising the RGB color signals and a total maximum value of the input RGB color signals, to compare the total maximum value with a predetermined critical value, to generate other RGB color signals so as to increase or decrease a brightness level of the input RGB color signals based on the comparison result, to compare the maximum values and if one of the maximum values is greater than the others to generate at least one RGB color signal having a color temperature varying by a predetermined value, to detect a total maximum value of the RGB color signals, and to store the total maximum value of the RGB color signals; and a system controller to provide the RGB color signal generator with data on the predetermined critical value, a reference value used for detecting the color signal having the higher maximum value than the others, and the predetermined value, wherein the RGB color signal generator generates RGB color signals having decreased brightness by decreasing the brightness level of the image by one of the plurality of the predetermined ratios if the total maximum value is greater than a first predetermined critical value, determined in a case wherein a brightness level of pixels in an area of the screen from which the total maximum value is detected corresponds to full white, wherein the RGB color signal generator generates RGB color signals having increased brightness by increasing the brightness level of the image by one of the plurality of the predetermined ratios if the total maximum value is less than a second predetermined critical value, determined in consideration of a case wherein a brightness level of pixels in the area of the screen from which the total maximum value is detected corresponds to full black, and wherein the detecting and storing a total maximum value of the RGB color signals includes windowing a predetermined area of the screen, and then detecting the total maximum value of the RGB color signals in the predetermined area.

12. The apparatus of claim 11, wherein the color temperature of the detected color signal is increased to the predetermined value.

13. The apparatus according to claim 11, wherein the color temperature and the brightness of the screen are automatically adjusted.

14. The apparatus of claim 1, wherein the RGB color signal generator detects a total maximum of the RGB color signals compares the total maximum value with the predetermined critical value, and generates RGB color signals so as to increase or decrease the brightness level of the image displayed on the screen.

15. A method of adjusting brightness and a color temperature of a screen on which input RGB signals are displayed, the method comprising:

detecting and storing maximum values of each of the RGB color signals;

comparing the maximum values to detect a color signal having a higher maximum value than the other color signals;

increasing a color temperature of the detected color signal to a predetermined value to compensate for the color temperature of the detected color signal if the color is detected; and generating RGB color signals so as to increase or decrease a brightness level of an image displayed on the screen by one of a plurality of predetermined ratios;

detecting and storing a total maximum value of the RGB color signals; and comparing the total maximum value with a predetermined critical value, wherein generating the RGB color signals so as to increase or decrease the brightness level of the image displayed on the screen is based on the comparison result for the total maximum value with the predetermined critical value, wherein generating the RGB signals generates RGB color signals having decreased brightness by decreasing the brightness level of the image by one of the plurality of the predetermined ratios if the total maximum value is greater than a first predetermined critical value, determined in a case wherein a brightness level of pixels in an area of the screen from which the total maximum value is detected corresponds to full white, wherein generating the RGB color signals generates RGB color signals having increased brightness by increasing the brightness level of the image by one of the plurality of the predetermined ratios if the total maximum value is less than a second predetermined critical value, determined in consideration of a case wherein a brightness level of pixels in the area of the screen from which the total maximum value is detected corresponds to full black, and wherein the detecting and storing a total maximum value of the RGB color signals includes windowing a predetermined area of the screen, and then detecting the total maximum value of the RGB color signals in the predetermined area.

16. The method according to claim 15, wherein the adjusting the brightness and the color temperature of the screen are automatic.

* * * * *